United States Patent [19]

Naumann et al.

[11] Patent Number: 4,665,721

[45] Date of Patent: May 19, 1987

[54] WARP KNITTING MACHINE FOR DIAGONALLY LAYABLE THREADS

[75] Inventors: Rolf Naumann, Muhlheim; Gerhard Hittel, Rodgau, both of Fed. Rep. of Germany

[73] Assignee: Karl Mayer Textilmaschinenfabrik GmbH, Obertshausen, Fed. Rep. of Germany

[21] Appl. No.: 894,627

[22] Filed: Aug. 8, 1986

[30] Foreign Application Priority Data

Aug. 16, 1985 [DE] Fed. Rep. of Germany ..... 3529415

[51] Int. Cl.[4] ..... D04B 23/00

[52] U.S. Cl. ..... 66/203; 66/84 A

[58] Field of Search ..... 66/125, 203, 81, 84 A

[56] References Cited

FOREIGN PATENT DOCUMENTS 290176 10/1913 Fed. Rep. of Germany ..... 66/84

OTHER PUBLICATIONS

Paling, D. F., "Warp Knitting Technology", Harlquin Press, London, 1952, pp. 201-210.

*Primary Examiner*—Ronald Feldbaum

*Attorney, Agent, or Firm*—Omri M. Behr

[57] ABSTRACT

There is provided a warp knitting machine for diagonally laying warp threads with thread guides that circulate around a continuous pathway. The warp threads are taken from spools located on a fixed creel and are led through a fixed thread feed arrangement located above the circulating path. The frame is rotatable about a perpendicular turning axis in a direction opposite to the direction of rotation of the thread guides. These rotations have the same circuit times. In this way it is possible to provide long time intervals between the stopping times necessary for the replacement of the spools. It also allows the use of many different types of thread material.

10 Claims, 3 Drawing Figures

WARP KNITTING MACHINE FOR DIAGONALLY LAYABLE THREADS

BACKGROUND OF THE INVENTION

The present invention is directed to a warp knitting machine for diagonally layable warp threads. This machine is provided with a frame comprising the needle bed, a motor-driven main shaft, and a laying arrangement whose thread guides are movable across the breadth of the needle bed and back. A large number of weft threads are provided to the knitting machine from reserve spools.

Warp knitting machines of this type have been know for decades as Milanese machines. Since the thread guides for providing the warp threads (or a part of the warp threads) to the machine run on a circular path, the finished fabric contains warp threads which generally speaking run diagonally from one fabric edge to the other and back. The thread guides are constructed either as holes in a continuous band or as thread guides on displaceable individual carriers. They are able to carry out controlled movements with at rest positions and rearward displacement so that a patterning is achieved. The warp threads are provided from partial warp beams which lie over the laying arrangment and similarly over the circular path and have a circulation time equal to that of the lapping arrangement. The warp beams are small since otherwise problems will occur when they are moved on a circular path. Therefore, large changes are required of the partial warp beams, even when one works with thin threads.

Accordingly there is a need for a warp knitting machine of the aforegoing type which requires less use of new thread provision bodies and which permits the use of whatever threads desired, particularly thicker threads.

SUMMARY OF THE INVENTION

In accordance with the disclosed embodiments demonstrating features and advantages of the present invention, there is provided a warp knitting machine for diagonally laying warp threads. The machine has a frame secured to rotate about a fixed axis and a needle bed mounted on the frame to reciprocate with respect to it. The machine also has a motor-driven main shaft rotatably mounted on the frame. Also included is a drive means coupled to and driven by the main shaft to rotate the frame. The machine also has a lapping arrangement mounted on the frame. The lapping arrangement includes thread guides mounted to circulate across the breadth of the needle bed in a direction opposite to the direction of rotation of the frame. The frame and the thread guides have the same period of cycling. The machine also includes a spool storage device having a plurality of spools of thread located upon a fixed creel.

In a preferred embodiment, the thread supply is on spools in a fixed creel and is fed out through a fixed thread guide arrangement lying above the lapping arrangement. Preferably, the machine frame rotates around a vertical axis opposite to the circulating direction of the thread guides but with the same rotation time.

With the foregoing apparatus, unless steps are taken, threads from a creel would become tangled because of the circulation of the thread guides. In order to prevent this, the frame of the warp knitting machine must be turning in the opposite direction. The turning herein may be so slow that service personnel for the machine are perfectly capable of manually watching for errors.

The frame can be continually turnable. This gives rise to a rather simple construction. In particular, it is possible to provide a simple drive means. For example, the frame can be mounted on a turntable which is drivable by means of a reduction gear from the main shaft of the machine. As disclosed hereinafter, more complex rotation schemes are contemplated as well.

It is further advantageous if the number of spools in the creel is chosen to be so large with respect to the working speed of the machine, that the circulating speed of the frame is less than one revolution per minute, suitably less than half a revolution pwer minute. It is therefore advantageous to work with a larger number of warp threads and therefore a larger creel.

BRIEF DESCRIPTION OF THE DRAWINGS

The invention may be illustrated by reference to the following drawings, wherein.

DETAILED DESCRIPTION OF THE PREFERRED EMBODIMENTS

Figure 1:
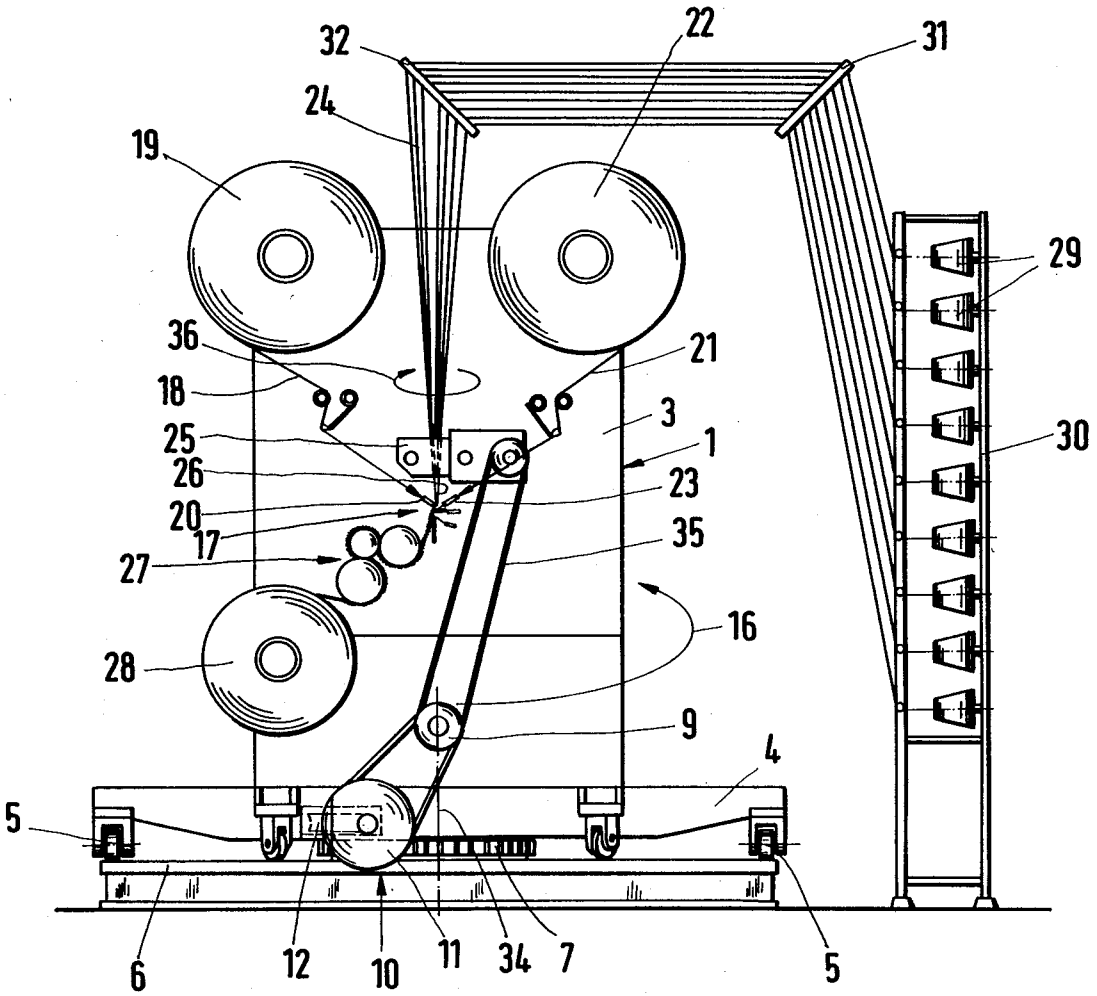
FIG. 1 is a side elevational view of the machine of the present invention showing the positioning of the appropriate creel.

The preferred machine of the present invention comprises a frame 1 having two side portions 2 and 3 which are mounted on a turntable 4. This turntable 4 runs on several peripherally mounted rollers 5 rolling on base plate 6. Base plate 6 has affixed to it central fixed gear wheel 7. Bevel gear 8, supported on frame 1, engages gear wheel 7 and by turning turns frame 1. Bevel gear 8 is driven by main shaft 9 through tooth belt 11, reduction gear 10 and gear box 12. In FIG. 1 the gear box 12 comprises a simple tooth drive. The main shaft 9 is driven by a motor 14 through belt drive 15. The normal turning direction of the frame 1 is indicated by arrow 16.

Figure 2:
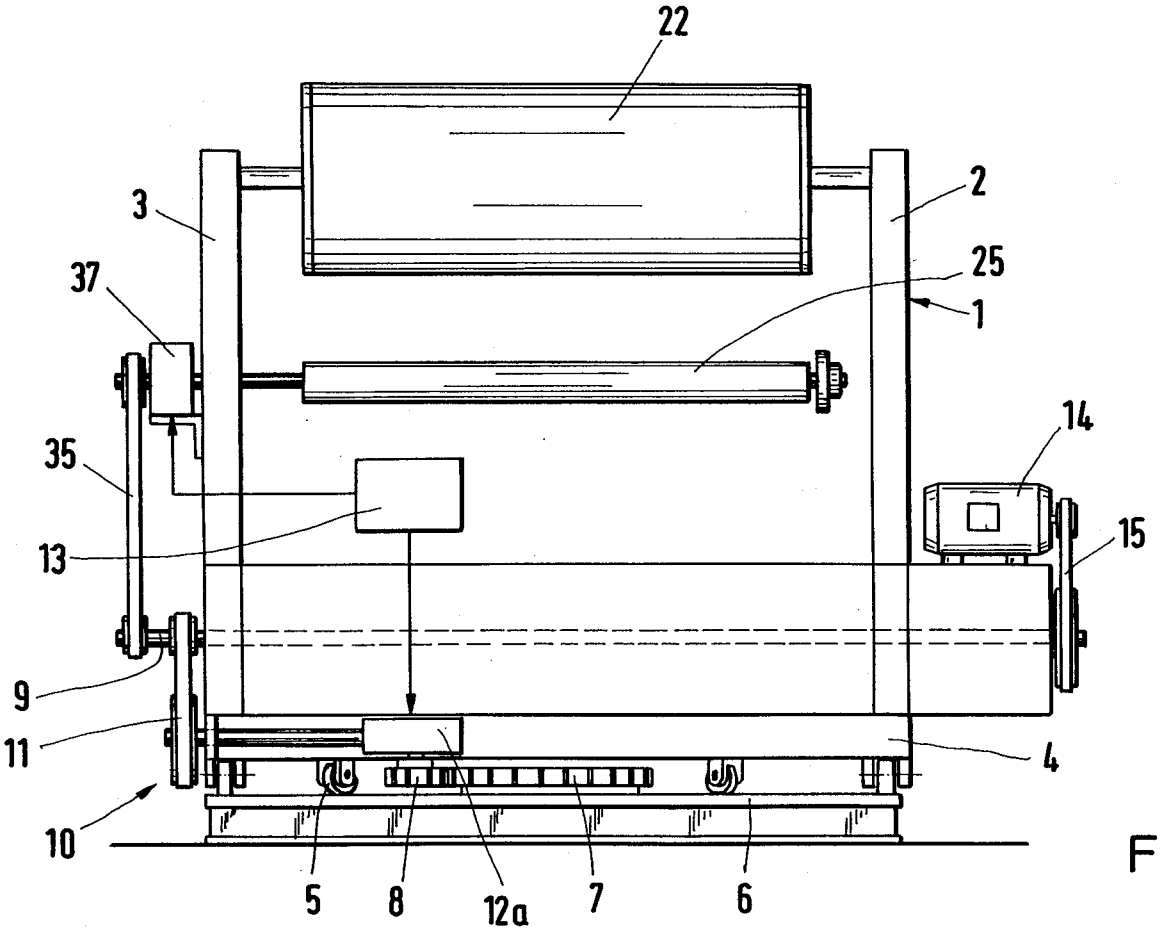
FIG. 2 is a front elevational view of the machine of FIG. 1.

In FIG. 2 gear box 12A is provided as a stepping gear which can be controlled by program arrangement 13. For example, box **12*a* can be an electricaly controllable transmission. Arrangement 13 can control such a transmission with a cam driven potentiometer or switch contacts (neither shown) connected to the transmission 12*a* either directly or through a programmable computer (not shown). Arrangement 13** can operate to control turning speed, turning direction and even stopping times in accordance with a predetermined program.

The frame 1 supports a working area 17 to which warp threads 18 are led from a warp beam 19 over a guide bar 20. Warp threads 21 run from warp beam 22 over guide bar 23. Guide bars 20 and 23 are arranged to reciprocate through the usual shogging and/or swinging motions. Warp threads 24 are fed over a laying arrangement 25 via its circulating thread guides 26. The working area 17 is provided with a fabric take off arrangement 27 comprising three take off rollers and a fabric winding roller 28.

The warp threads 24 are pulled off individual spools 29 on a fixed creel 30 and run over two stationary thread guide arrangements 31 and 32 of the lapping arrangement 25. The use of stationary creel 30 makes it possible for the threads 24 to be led from single spools 29. Such single spools 29 can carry substantially larger amounts of threads than a single movable partial warp beam. One can use supersized spools carrying higher weights of thread, for example, 15 kilograms. It is therefore possible to use much thicker threads which are, for example, useful for reinforcement purposes and which can be held in longer lengths on the spools 29. It is also possible to utilize thread materials such as glass or carbon fibers which cannot be warped on warp beams. Indeed, it is possible to construct a creel 30 which is much larger than the rest of the machine. Even the weight of the creel 30 plus the weight of the full spools can be greater than the weight of the machine itself. Because of the separate stationary creel 30, vibrations during thread take-off are, to all intents and purposes non-existent.

The thread guide arrangement comprises a eyelet plate 32 and 31 each of which have one guide opening or eyelet 33 for each weft thread. In the illustrated example of FIG. 3, the eyelet plate 32 is annular and the eyelets 33 are placed circularly around its circumference.

It is advantageous if the turning axis of the frame 1 runs through the center of the eyelet plate 32. This gives great assurance that individual threads 24 do not touch each other. In particular, the thread guide arrangement 32 may be formed by a eyelet plate 32 with equally spaced eyelets 33. It is advantageous if these eyelets 33 are set around a circle with the eyelet plate 32 shaped in the form of a ring since tangling is then very unlikely even though the emerging threads may leave at time-varying angles. Such an arrangement provides an easy way of preventing mutual interference between the strings 24.

The frame 1 comprises a turning axle 34 which by cooperating with guiding wheels 5 through a central trunion, nipple or other means may be definitely determined. The central axis 34 runs through the guiding arrangement 32.

Figure 3:
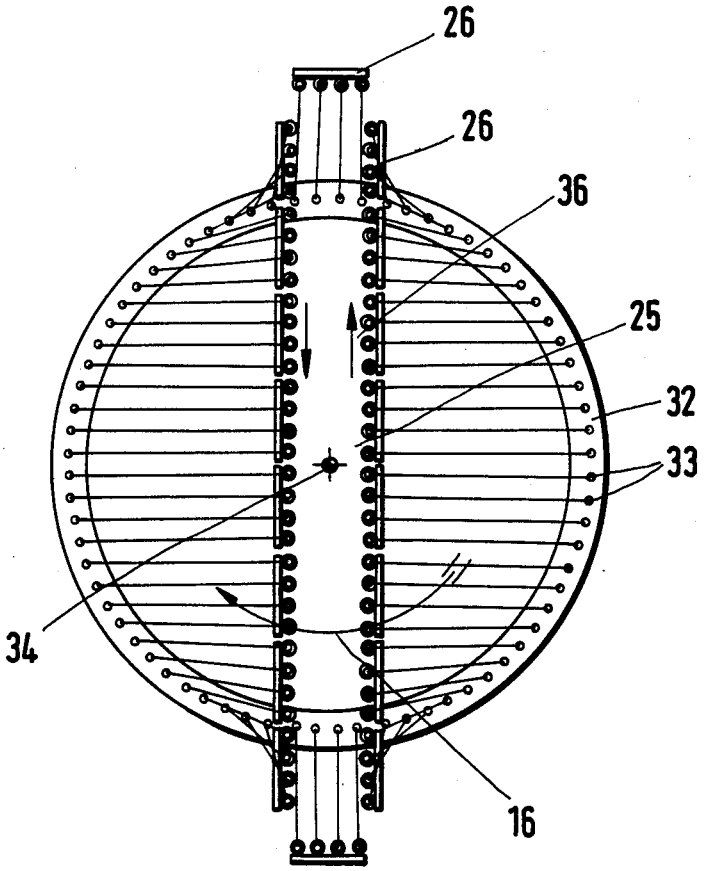
FIG. 3 is an upward plan view of the underside of the laying arrangement of FIG. 1.

The lapping arrangement 25 is similarly driven from main shaft 9 over a toothed belt 35 in such a manner that the threads 24 move in the direction shown by arrow 36 (if lapping arrangement 25 is taken as a frame of reference). In FIG. 3 where the lapping arrangement 25 is viewed from below, the circulation direction 36 of the lapping arrangement 25 and the turning direction 16 of the frame 1 are similarly indicated.

In FIG. 2 an intermediate drive 37, for example, a stepping drive, is provided which is controlled by a program arrangement 13 by the means of which the lapping pattern may be provided with changes in the circulation movement. For example stopping, higher speed, reverse direction may be imposed on lapping arrangement 25. The circulatory movement of the lapping arrangement 25 and the adjustments to the average speed of frame 1, which are controlled by program arrangement 13, are thereby advantageously adjusted to each other.

There remains the possibility that while the lapping arrangement 25 is subject to a predetermined program control, the frame 1 is continuously driven in such a manner that the circulation time of the frame 1 is equal to the circulation time of the lapping arrangement 25. Under such circomstances, the lapping arrangement 25 can be set up in the known manner, that is to say, be provided with a circulating band with holes or with individual step-wise displaceable carrier elements. It is preferred, however, to utilize an arrangement as is set forth in our co-pending and co-filed application Ser. No. 894,563 filed Aug. 8, 1986 entitled "CIRCULATING THREAD GUIDES."

Synchronization is assured because of the mutual coupling of the lapping arrangement 25 and the turning drive for frame 1 with the main shaft 9 which also drives the knitting arrangement. It is possible to exactly determine the circulation of the thread 24, the turning of the frame 1 and the production speed as well as also the progress of creep. It is also possible to provide a programming arrangement which gives the frame 1 different turning speeds, non-motion and/or different circulation times. This can be advantageous, for example, if the laying arrangement 25 does not run continuously in the circuit, but has a pre-programmed timing and thus the fed thread would collide with each other if the frame turned continually under these circumstances. In particular, the turning drive of the frame 1 should correspond to the appropriate speed, stopping motion and reverse motion of the circulating drive of the thread guides 26.

In each case the warp threads 24 give rise to diagonal patterns on the fabric. In the experimental example a 60 inch (1524 mm) wide machine equipped with seven needles per inch was used. This gives rise to 360 threads on the forward level and 360 on the rearward level. To this are added 2 times 6 threads on the edge in the turning position, thus there are utilized 732 threads per revolution. The machine ran at a working speed of 300 working rows per minute. This corresponds to 0.406 machine circuits per minute at such a speed it is clearly possible for the operator to manually correct and observe any errors.

Frame 1 can also be equipped with a weft thread insert magazine and further thread provision arrangements as is usual. Using this machine it is possible to provide fabric with particularly strong reinforcing threads in all directions which provides high fabric stability as is described in DEOS No. 3304345.

Obviously, many modifications and variations of the present invention are possible in light of the above teachings. It is, therefore, to be understood that within the scope of the appended claims, the invention may be practiced otherwise than as specifically described.

What is claimed is:

1. A warp knitting machine for diagonally laying warp threads, comprising:

a frame secured to rotate about a fixed axis;

a needle bed mounted on said frame to reciprocate with respect to it;

a motor-driven main shaft rotatably mounted on said frame;

drive means coupled to and driven by said main shaft to rotate said frame;

a lapping arrangement mounted on said frame and having thread guides mounted to circulate across the breadth of said needle bed in a direction opposite to the direction of rotation of said frame, said frame and said thread guides having the same period of cycling; and a spool storage device having a plurality of spools of thread located upon a fixed creel.

2. A warp knitting machine according to claim 1 wherein said lapping arrangement includes:

a stationary thread feed arrangement between said spool storage device and said thread guides.

3. A warp knitting machine in accordance with claim 2 wherein the axis of rotation of said frame passes through said stationary thread feed arrangement.

4. A warp knitting machine according to claim 3 wherein said thread feed arrangement comprises:

an eyelet plate having a plurality of eyelets.

5. A warp knitting machine in accordance with claim 4 wherein said eyelets are arranged in a circle.

6. A warp knitting machine in accordance with claim 1 wherein said frame is continually rotatable.

7. A warp knitting machine in accordance with claim 6 further comprising:

a turntable onto which said frame is rotatably mounted, said drive means having a speed reduction means coupled to and driven by said main shaft to rotate said frame with respect to said turntable.

8. A warp knitting machine in accordance with claim 1 further comprising:

program means coupled to said lapping arrangement and said drive means for controlling rotation of said frame to permit different rotation speeds, including the ability to be stationary or run backwards for predetermined times.

9. A warp knitting machine in accordance with claim 8 wherein the turning of said frame by said drive means corresponds with respect to speed, stopping time, and reverse time to the circulation of said thread guides.

10. A warp knitting machine in accordance with claim 1 wherein the spools in said creel are sufficiently numerous with respect to the knitting speed that the circulating time of said frame is less than one revolution per minute, preferrably about half a revolution per minute.

* * * * *